US006481595B1

(12) United States Patent
Chilton

(10) Patent No.: US 6,481,595 B1
(45) Date of Patent: Nov. 19, 2002

(54) BALL STORAGE AND DISPENSING DEVICE AND METHOD OF MANUFACTURE

(76) Inventor: Mark Chilton, 643 Court St., Elko, NV (US) 89801

( * ) Notice: Subject to any disclaimer, the term of this patent is extended or adjusted under 35 U.S.C. 154(b) by 0 days.

(21) Appl. No.: 09/492,432

(22) Filed: Jan. 27, 2000

(51) Int. Cl.[7] ..... A24F 15/04
(52) U.S. Cl. ..... 221/185; 224/919
(58) Field of Search ..... 221/185, 191; 224/274, 919, 918, 251; 206/315.9

(56) References Cited

U.S. PATENT DOCUMENTS

| | | | | |
|---|---|---|---|---|
| 2,221,704 | A | 11/1940 | Farley | |
| 2,756,914 | A | 7/1956 | Bonderer | |
| 2,768,775 | A | * 10/1956 | Houser | 224/5 |
| 2,780,508 | A | 2/1957 | Bonderer | |
| 4,678,108 | A | 7/1987 | Inman | |
| D300,447 | S | 3/1989 | Timleck | |
| 4,840,332 | A | 6/1989 | Hoyt | |
| 4,850,483 | A | * 7/1989 | Stack | 206/315.9 |
| 5,183,154 | A | 2/1993 | Slemp | |
| 5,533,646 | A | 7/1996 | Dildine | |
| 5,554,077 | A | 9/1996 | Coles | |

OTHER PUBLICATIONS

One page specification titled "Golf Ball Caddy" prepared by the applicant before the filing date of the instant application. Two page specification titled "Golf Ball Caddy" prepared by the applicant before the filing date of the instant application. Four photographs of a golf ball carrier admitted to be prior art taken for purposes of this Information Disclosure Statement.

* cited by examiner

*Primary Examiner*—Kenneth W. Noland
(74) *Attorney, Agent, or Firm*—Roger S. Dybvig

(57) ABSTRACT

A ball storage and dispensing device comprises a one-piece, hollow, cylindrical storage tube for storing balls. The tube has an internal diameter over substantially its entire length which is greater than the diameter of any of the balls to be stored. The lower end of the tube has a bottom opening which is smaller than the internal diameter of the rest of the tube and of a size and shape to prevent balls stored in said tube from falling downwardly out of the tube. In addition, the lower end of the tube has a ball-dispensing aperture spaced above the bottom opening, and the bottom opening is sufficiently large to permit an individual to insert a finger upwardly through the bottom opening and push a ball at the bottom of the tube upwardly and outwardly through the ball-dispensing aperture. The restriction in the size of the bottom opening is obtained by indenting the wall of the tube.

15 Claims, 2 Drawing Sheets

BALL STORAGE AND DISPENSING DEVICE AND METHOD OF MANUFACTURE

FIELD OF THE INVENTION

This invention relates to a ball storage and dispensing device that can be used for storing and dispensing balls or ball-shaped articles. (To avoid unnecessary verbiage, the term "ball" as used in this specification and the claims that follow include balls and ball-shaped or nearly ball-shaped articles.) This invention is primarily intended for mounting onto golf carts to store and dispense golf balls. However, this invention could be used to store and dispense many other objects, such as baseballs or marbles. This invention also relates to a method of manufacture of a ball storage and dispensing device.

BACKGROUND OF THE INVENTION

Many devices have been developed for storing and dispensing golf balls and other balls or ball-shaped articles. Some of these devices have open bottoms which are smaller than the balls to be stored but sufficiently large to permit a user's finger to be inserted through the open bottom and push the lowermost ball in the tube out through a dispensing aperture in the wall of the tube. However, the known devices are expensive to manufacture and many include moving parts, such as springs, which limit their useful lives. There is a need for ball storage and dispensers which are inexpensive to manufacture, easy to install, easy to use, rugged and durable.

SUMMARY OF THE INVENTION

An object of this invention is to provide a ball storage and dispensing device which has one or more, and preferably all, of the attributes of being inexpensive to manufacture, easy to install, easy to use, rugged and durable. Another object of this invention is to provide a ball storage and dispensing device which can be used to store balls having diameters within a reasonable tolerance range so that it may be used, for example, to store and dispense golf balls ranging from the small, European size to oversize balls such as the well-known Top-Flite Magna golf balls.

A ball storage and dispensing device in accordance with this invention comprises a one-piece, hollow cylindrical storage tube or cartridge for holding a stack of balls, the tube having an internal diameter throughout substantially its entire length that is larger than the largest diameter ball with which the device is intended to be used.

Further in accordance with this invention, means are provided for mounting the tube in a vertical or nearly vertical orientation. The lower end of the tube is formed to have a non-circular shape with no open dimension sufficiently large to permit the smallest of the balls to be stored to fall downwardly out of the tube. However, the lower end of the tube is sufficiently large to permit a user to insert a finger through the bottom opening. These conditions may be readily obtained by indenting the side wall of the tube at the lower end of the tube. A ball-dispensing aperture is provided in the wall of the tube near its open bottom, preferably spaced from the open bottom by a distance which is a fraction of the diameter of any ball to be stored in the tube. The ball-dispensing aperture is preferably significantly larger than the diameter of any ball to be stored so that it is easy for a user to press upwardly on the lowermost ball in the tube and push that ball out through the ball-dispensing aperture.

Many simple mounting arrangements could be provided to clamp or otherwise connect the tube to a support member so that the tube is mounted in an upright, vertical or nearly vertical, orientation. It is presently preferred to provide screw-receiving bores in the wall of the tube to receive self-tapping screws used to mount the tube, for example, on a golf cart window frame. One or more access openings can be provided to enable access to the screw heads by a suitable screw driver or other tool.

As for the method of manufacture, a thermoplastic tube can be cut to a desired length and drilled as necessary to provide the ball-dispensing aperture and bores and openings for a mounting arrangement. Either before or after drilling the tube, the lower end of the tube is heated, as by the use of a heat gun, causing a portion of the lower end of the tube to become pliable. The pliable portion is then pressed against a forming member to form an indentation in the wall of the tube to restrict the size of the bottom opening of the tube.

Other objects and advantages will become apparent from the following description and the accompanying drawings.

DETAILED DESCRIPTION

Figure 1:
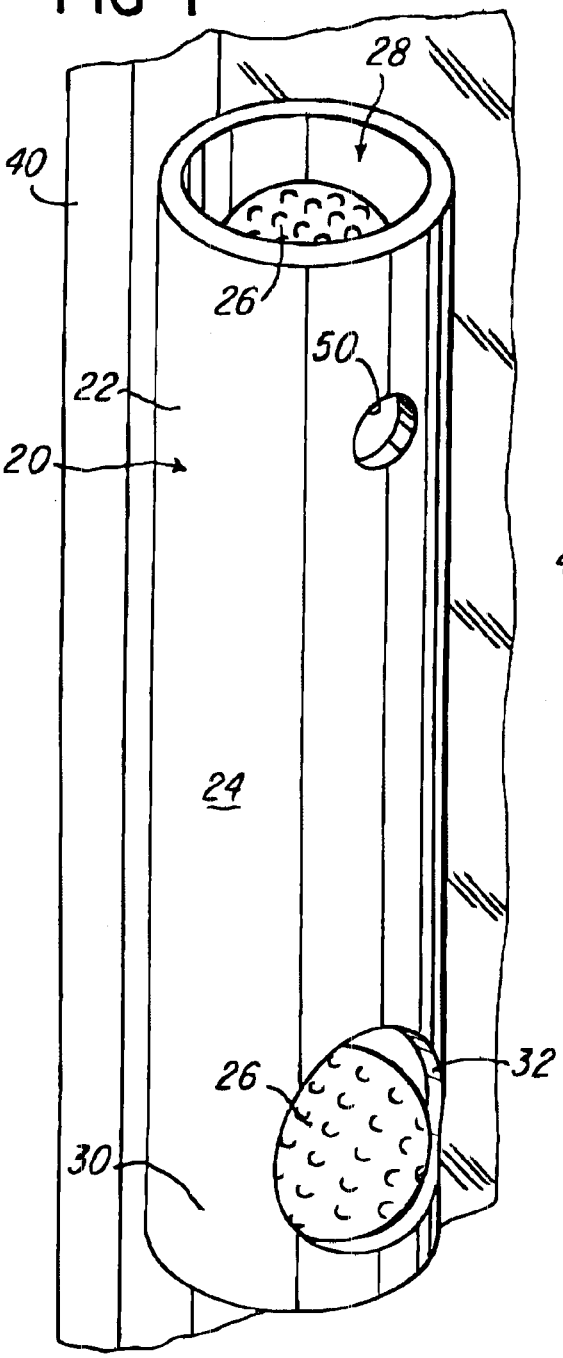
FIG. 1 is a fragmentary perspective view showing a ball storage and dispensing device of this invention mounted on a golf cart roof support or windshield frame.
Figure 2:
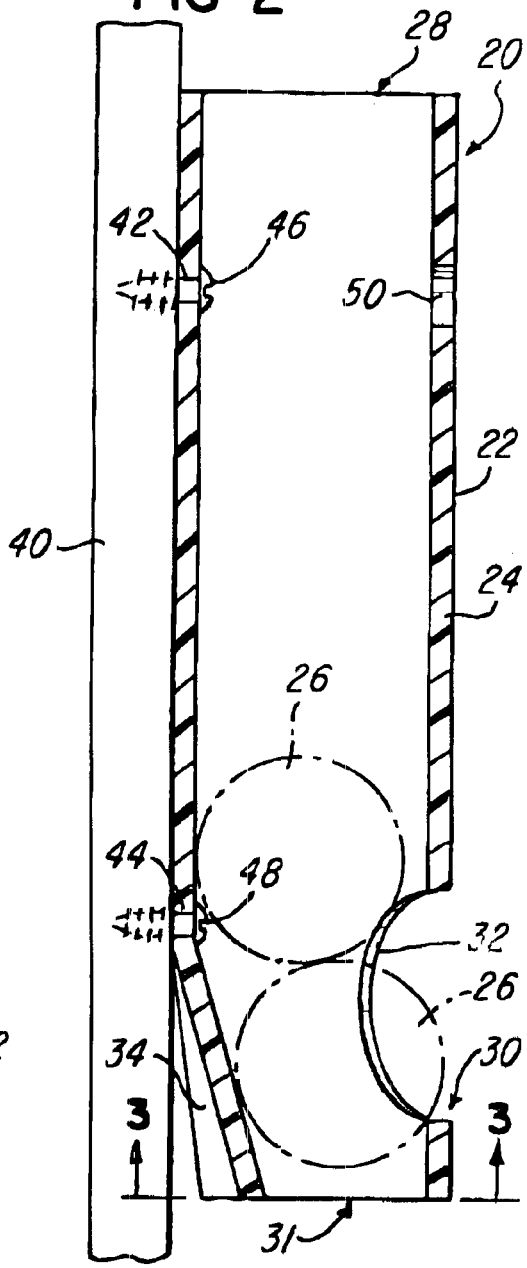
FIG. 2 is a side elevational view of the device and the support or frame of FIG. 1 with the device shown in cross section.
Figure 3:
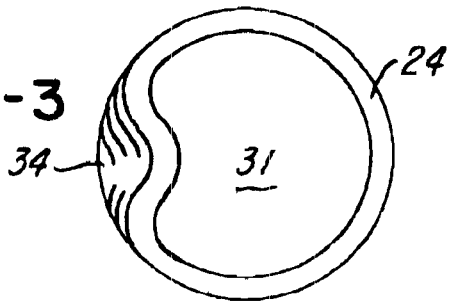
FIG. 3 is an bottom plan view of the device of FIG. 1, viewed in the direction of arrows 3—3 of FIG. 2.

With reference to FIGS. 1, 2 and 3, a ball storage and dispensing device of this invention is generally designated 20 and comprises a hollow, cylindrical storage tube or cartridge 22 having a cylindrical wall 24 for storing balls, such as the illustrated golf balls 26. The tube 22 has an open upper end 28 and an open lower end 30. Except as described below, the tube 22 preferably has a uniform internal diameter which is greater than the diameter of any of the balls to be stored in the tube 22. The exception is that the tube's lower end 30 is made non-circular so that the bottom opening 31 of the tube 22 is smaller than the internal diameter of the rest of the tube 22 and any ball that is to be stored in the tube 22. Therefore, balls stored in the tube 22 cannot fall downwardly through the bottom opening 31.

A ball-dispensing aperture 32 is located above the bottom opening 31 so that the lowermost ball stored in the tube 22 can be pushed upwardly and out of said tube 22 through the ball-dispensing aperture 32 by a user who inserts a finger through bottom opening 31 to push the lowermost ball out through the ball-dispensing aperture 32. For this reason, the bottom opening 31 must be sufficiently large to enable a user of the device 20 to extend a finger through the bottom opening 31 to engage the golf ball located at the lower end of the tube 22.

The open upper end 28 of the tube 22 preferably has the same internal diameter as most of the rest of the tube 22 so that balls may be freely loaded into the tube 20 without restriction.

The reduced size of the lower end of the tube 30 can be achieved by indenting a portion 34 of the wall 24 inwardly generally toward the centerline of the tube 22, i.e. inwardly generally toward a diametrically opposite portion of the tube 22.

In FIGS. 1 and 2, the device 20 is shown mounted on a golf cart window frame or roof support member 40. For this purpose, a pair of bores 42 and 44 extend through the rear of the tube wall 24 through which self-tapping mounting screws 46 and 48 are extended into engagement with the window frame or roof support member 40. One or more access openings 50 are provided to enable an installer to extend a screw driver (not shown) diametrically through the tube 22 to engage the screws 46 and 48 for inserting or removing them. In the embodiment shown in the drawings, the ball-dispensing aperture 32 also serves as an access opening to enable a screw driver to engage the lower mounting screw 48.

Figure 4:
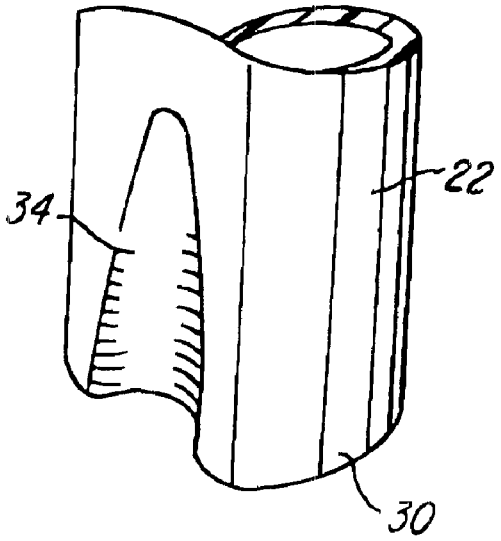
FIG. 4 is a fragmentary perspective view of the lower end of the device of FIG. 1.
Figure 5:
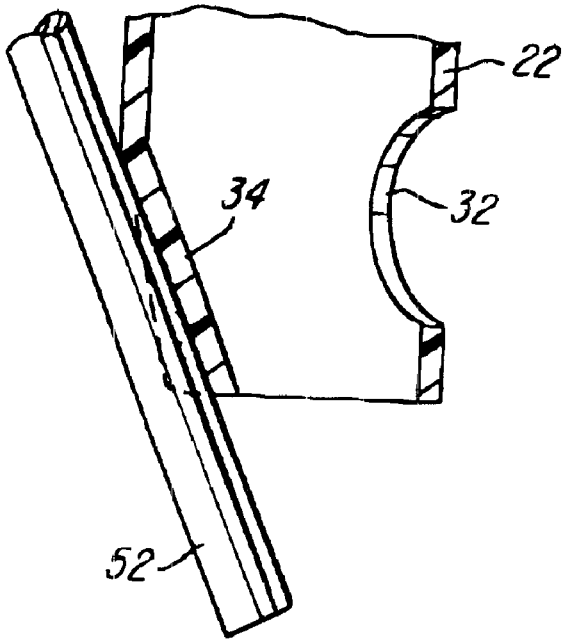
FIG. 5 is fragmentary cross sectional view of the tube of FIG. 1 and a portion of a fixture used to indent the lower end of the tube.

The tube 22 can be made from various materials, including wood, metal and plastic. The presently preferred material is a thermoplastic material, such as ABS, which is inexpensive, rugged readily available, and easily machined. If a thermoplastic material is used, after the tube 22 is formed, as by cutting a longer tube to a desired length, a portion of. the tube lower end can be heated, as by use of a heat gun (not shown), until it becomes pliable. The pliable portion can then be indented to form the indentation 34 by pressing the pliable portion of the tube 22 against a forming tool, such as the metal rod 52 illustrated in FIG. 5. The indentation 34 thereby is formed to the somewhat parabolic shape evident in FIGS. 2, 3 and 4. Other, more sophisticated, methods could be used for forming the indentations 34. Also, other methods of manufacture and other materials may be used. For example, the tube 22 could be fabricated from metal or it could be molded to the illustrated shape from a thermosetting plastic.

For use as a golf ball storage and dispensing device, tubes 22 have been successfully constructed using ABS waste water pipe having an internal diameter of two inches and cut to a length of 10 inches. A tool was made in which the metal rod 52 is a ½ inch stainless steel rod held fixed to a base plate (not shown) provided with a guide (not shown) for guiding a heated tube 22 at an appropriate angle relative to the rod 52 into engagement with the metal rod 52.

Storage and dispensing devices 20 of this invention made from a thermoplastic material are inexpensive to manufacture and have no moving parts to wear or break. The devices 20 can be installed on golf carts in less than two minutes per cart, requiring only an electric drill, the self-tapping screws, and an appropriate screw driver. Because of the open-ended construction of the devices 20, they do not accumulate rain water or debris and are easy to keep clean.

Although the presently preferred embodiments of this invention have been described, it will be understood that within the purview of the invention various changes may be made within the scope of the following claims.

Having thus described my invention, I claim:

1. A ball storage and dispensing device comprising a one-piece, hollow, cylindrical storage tube having a cylindrical wall for storing balls, said tube having an internal diameter over substantially its entire length which is greater than the diameter of any of the balls to be stored therein, the lower end of said tube having a bottom opening which is smaller than the internal diameter of the rest of the tube and of a size and shape to prevent balls stored in said tube from falling out of the tube through said bottom opening, said lower end of said tube having a ball-dispensing aperture larger than the diameter of any ball stored in the tube, said aperture being spaced above said bottom opening and separated therefrom by said wall, and said bottom opening being sufficiently large to permit an individual to insert a finger upwardly through said bottom opening and push a ball at the bottom of said tube upwardly and outwardly through said ball-dispensing aperture.

2. The device of claim 1 wherein the portion of said wall defining said bottom opening has an indentation which restricts the size of said bottom opening.

3. The device of claim 2 wherein said tube comprises an ABS pipe.

4. The device of claim 3 wherein said tube, except for the indented portion thereof, has an internal diameter of two inches.

5. The device of claim 1 wherein said tube has an open upper end.

6. The device of claim 1 wherein said tube is made from plastic.

7. The device of claim 1 wherein said tube is made from a thermoplastic plastic.

8. The device of claim 1 wherein said tube is molded from a thermosetting plastic.

9. A ball storage and dispensing device comprising a one-piece, hollow, cylindrical storage tube having a cylindrical wall for storing balls, said tube having an internal diameter over substantially its entire length which is greater than the diameter of any of the balls to be stored therein, said tube being provided with at least one bore through which mounting screws can be extended for mounting said tube on a support member, the lower end of said tube having a bottom opening which is smaller than the internal diameter of the rest of the tube and of a size and shape to prevent balls stored in said tube from falling out of the tube through said bottom opening, said lower end of said tube having a ball-dispensing aperture spaced above said bottom opening, and said bottom opening being sufficiently large to permit an individual to insert a finger upwardly through said bottom opening and push a ball at the bottom of said tube upwardly and outwardly through said ball-dispensing aperture.

10. The device of claim 9 wherein said tube is provided with at least one access hole through which a tool such as a screw driver may be inserted to engage the head of a mounting screw extended through said at least one bore.

11. In a method of manufacturing a ball storage and dispensing device, the steps comprising: providing a cylindrical thermoplastic tube having a uniform internal diameter which is larger than the diameter of balls to be stored therein, an open bottom, and a ball-dispensing aperture which is larger than the diameter of any ball to be stored, and indenting a portion of the wall of said tube angularly spaced from said aperture to reduce the size of the opening at the bottom end of the tube to prevent balls stored in the tube from passing through said opening.

12. The method of claim 11 wherein the wall of said tube is indented by providing a forming tool, heating a portion of said tube until it becomes pliable, and engaging said pliable portion with said forming tool to indent said pliable portion.

13. The method of claim 12 wherein said forming tool is a metal rod.

14. In a method of manufacturing a ball storage and dispensing device, the steps comprising: providing a cylindrical thermoplastic tube having a uniform internal diameter which is larger than the diameter of balls to be stored therein and indenting a portion of the wall of said tube to reduce the size of the opening at one end of the tube to prevent balls stored in the tube from passing through said opening, the wall of said tube being indented by providing a forming tool, heating a portion of said tube until it becomes pliable, and engaging said pliable portion with said forming tool to indent said pliable portion.

15. The method of claim 14 wherein said forming tool is a metal rod.

* * * * *